US006530497B1

(12) United States Patent
Horn et al.

(10) Patent No.: US 6,530,497 B1
(45) Date of Patent: Mar. 11, 2003

(54) TRANSPORT DRUM FOR LIQUIDS

(75) Inventors: Joachim Horn, Seeheim-Jugenheim (DE); Martin Benzinger, Michelstadt (DE); Thomas Schwortschik, Edingen (DE)

(73) Assignee: Merck Patent GmbH, Darmstadt (DE)

( * ) Notice: Subject to any disclaimer, the term of this patent is extended or adjusted under 35 U.S.C. 154(b) by 0 days.

(21) Appl. No.: 09/529,799

(22) PCT Filed: Oct. 12, 1998

(86) PCT No.: PCT/EP98/06465

§ 371 (c)(1),
(2), (4) Date: May 26, 2000

(87) PCT Pub. No.: WO99/20535

PCT Pub. Date: Apr. 29, 1999

(30) Foreign Application Priority Data

Oct. 21, 1997 (DE) ..... 197 46 344

(51) Int. Cl.[7] ..... B65D 6/40

(52) U.S. Cl. ..... 220/661; 220/DIG. 6; 220/4.13

(58) Field of Search ..... 220/4.13, 1.5, 220/660, DIG. 6, 710

(56) References Cited

U.S. PATENT DOCUMENTS

| | | | | | |
|---|---|---|---|---|---|
| 3,347,401 | A | * | 10/1967 | Nataf | 215/389 |
| 4,966,293 | A | * | 10/1990 | Pfeiffer et al. | 220/1.5 |
| 5,078,286 | A | * | 1/1992 | Hashimoto | 215/389 |
| 5,353,983 | A | * | 10/1994 | Miller | 220/705 |
| 5,437,389 | A | * | 8/1995 | Kaufman et al. | 215/389 |
| 5,522,524 | A | * | 6/1996 | Nmngani | 220/705 |
| 5,544,777 | A | * | 8/1996 | Watson | 220/4.13 |
| 5,597,089 | A | * | 1/1997 | Smith | 215/389 |

FOREIGN PATENT DOCUMENTS

| | | |
|---|---|---|
| DE | 41 41 774 | 7/1993 |
| GB | 1 188 522 | 4/1970 |
| WO | 91 06503 | 5/1991 |
| WO | 91 13811 | 9/1991 |

* cited by examiner

*Primary Examiner*—Joseph M. Moy
(74) *Attorney, Agent, or Firm*—Millen, White, Zelano & Branigan, P.C.

(57) ABSTRACT

A plastic transporting container for liquids, in particular high-purity liquids, has a submersion tube (1) which extends from a top wall (2) of the container to the container base (3) and is integrally formed in the transporting container. At its end which opens out in the top wall (2) of the container, the submersion tube is provided with a screw-connection device (6).

11 Claims, 2 Drawing Sheets

TRANSPORT DRUM FOR LIQUIDS

Figure 1:
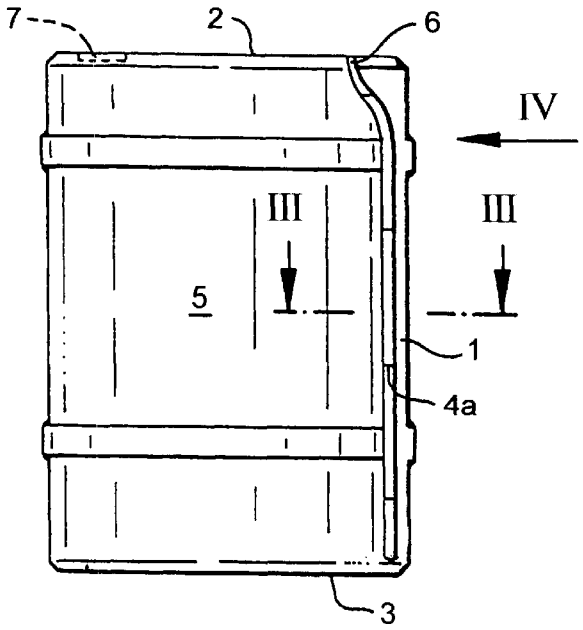

Transporting container for liquids The invention relates to a plastic transporting container for liquids, in particular high-purity liquids, having a submersion tube which extends from a top wall of the container to the container base. Transporting containers of this type are used for transporting liquids. In particular when used for high-purity liquids, in the case of which contamination by environmental influences has to be avoided, it is necessary, for emptying purposes, to have a submersion tube which extends virtually as far as the container base and, at its top end, is provided with a screw-connection device.

In the case of known transporting containers of the generic type mentioned in the introduction, the submersion tube usually consists of a plastic material other than that used for the actual transporting container, which is produced by blow moulding. Such submersion tubes are fastened in the top wall of the container in a sealing manner. The resulting outlay in terms of labour and cost is considerable; moreover, additional quality-assurance measures are necessary.

The object of the invention is thus to design a transporting container of the generic type mentioned in the introduction, such that it can be produced with comparatively low outlay and, in particular, there is no need for any measures for the subsequent fitting of a submersion tube.

This object is achieved according to the invention in that the submersion tube is integrally formed in the transporting container.

The submersion tube is thus produced as the actual plastic transporting container is produced, with the result that there is no need for any other production and assembly work.

With the same size of production batch, the production of the plastic container is not very much more expensive than that of transporting containers with a submersion tube which has to be fitted separately, although the outlay for fitting the immersion tube separately is done away with. The integral design of the submersion tubes means that a filling-level sensor can easily be fitted.

The reduction in the number of structural components for the transporting container, which is brought about by the integral design of the submersion tube, likewise reduces the production outlay and, at the same time, the possible errors during assembly and handling. Outlay in terms of cleaning is also reduced.

The submersion tube is preferably formed in an inner protrusion, running along a surface line, of the essentially cylindrical container wall of the transporting container. The fixed, integral connection of the submersion tube to the container wall secures the submersion tube on the container wall over its entire length, with the result that bending stresses which could occur as a result of movements in liquids in the case of a submersion tube which projects freely into the transporting container are completely avoided. In particular, it is not necessary either to provide a separate fastening at the bottom end of the submersion tube, which projects into the transporting container, as may be necessary in known transporting containers with submersion tubes which project freely into the container interior, at least if the submersion tubes are relatively long.

The transporting container is preferably a hollow body produced by blow moulding.

For use for high-purity chemicals, it is expedient for the transporting container to be produced as a hollow body by coextrusion blow moulding, the inner-wall material, which is selected specifically for the chemicals which are to be introduced, coating both the inner wall of the container and the submersion tube, with the result that all the surfaces which come into contact with the product are formed by this inner-wall material.

Further advantageous configurations of the idea of the invention form the subject matter of further subclaims.

Figure 2:
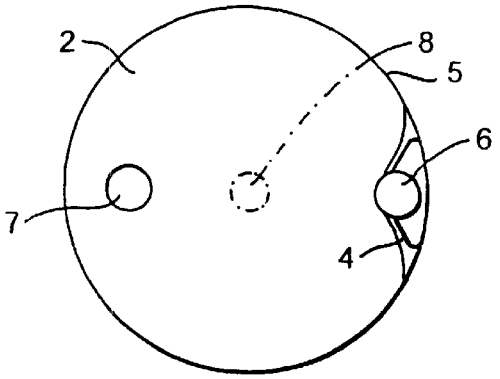
Figure 3:
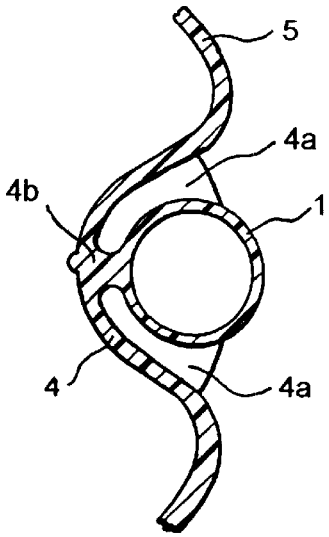
Figure 4:
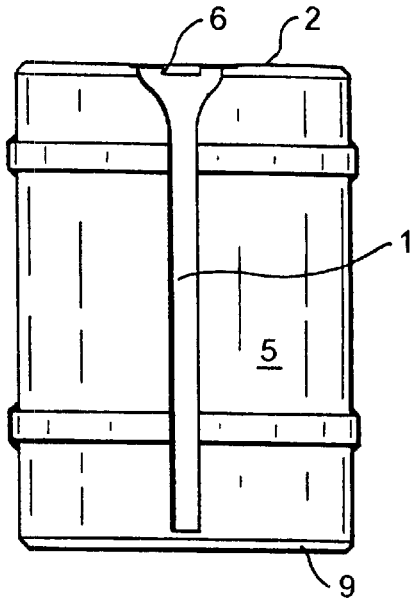
Figure 5:
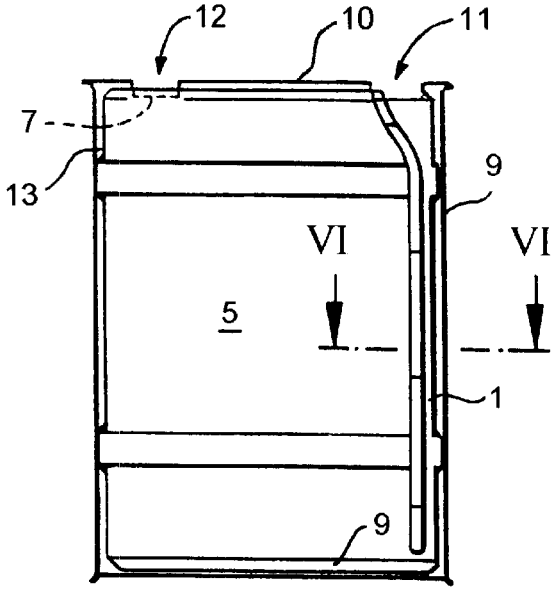
Figure 6:
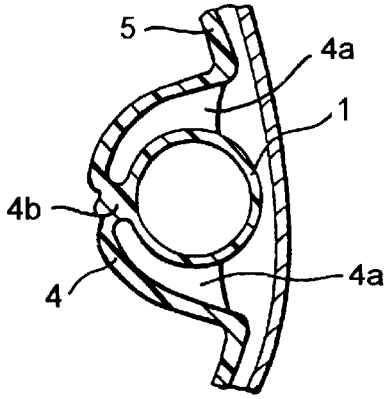

Exemplary embodiments are described in more detail hereinbelow and are illustrated in the drawing, in which:

FIG. 1 shows a longitudinal section of a transporting container for liquids, FIG. 2 shows a plan view of the transporting container according to FIG. 1, FIG. 3 shows an enlarged partial section along line III—III in FIG. 1, FIG. 4 shows a side view of the transporting container according to FIG. 1 in the direction of the arrow IV, FIG. 5 shows a modified embodiment of a transporting container in a longitudinal section corresponding to FIG. 1, and FIG. 6 shows an enlarged partial section along line VI—VI in FIG. 5.

The transporting container which consists entirely of plastic, and is illustrated in FIGS. 1–4, serves for receiving, storing and transporting high-purity liquids. It is produced by blow moulding and consists, for example, of polyethylene (PE).

An integrally formed submersion tube 1 extends from a top wall 2 of the container to a point located at a small distance above a container base 3. As can be seen in particular in FIG. 3, the submersion tube 1 is formed in an inner protrusion 4, which defines axially extending outwardly opening groove which runs along a surface line of the essentially cylindrical container wall 5. The submersion tube 1 is connected to the wall of the groove 4 by a web 4*b* which is unitary with the submersion tube 1 and with the wall of the groove and is stiffened with respect to the groove 4 by laterally extending stiffening ribs 4*a* extending between the wall of groove and submersion tube.

At its end which opens out in the top wall 2 of the container, the submersion tube 1 is provided with a screw-connection device 6. For this purpose, an internal thread is formed at the top end of the tube, it being possible for a screw-connection device for removal purposes to be screwed into said internal thread. The submersion tube 1 serves as a removal tube for emptying the transporting container.

As is shown in FIGS. 1 and 2, at least one closure opening 7 is provided in the top wall 2 of the container, and this opening may likewise have an internal thread for receiving a screw-action closure. In FIG. 2, a chain-dotted line indicates that it is possible for a further closure opening 8 of the same design as the closure opening 7 to be provided in the top wall 2 of the container.

As can be seen from FIGS. 1 and 4, the submersion tube 1 is widened at the point where it opens out in the region of the top wall 2 of the container, in order to provide sufficient space for the screw-connection device 6. The dip tube opening can be equipped with a filling-related mechanical key code. This is intended to ensure that a dispense connection to a supply system can not be completed when the product contained in the drum shall not be dispensed through said supply system.

Whereas the transporting container in the case of the embodiment illustrated in FIGS. 1–4 consists entirely of plastic in a single piece, the design according to FIGS. 5 and 6 provides that a plastic inner container 13, which is provided with an integrally formed submersion tube 1 and corresponds essentially to the design according to FIGS. 1 and 4, is introduced into a steel outer container 9. The outer container 9 preferably consists of high-grade steel and serves essentially for mechanical reinforcement of the transporting container. In the region where the submersion tube 1 opens out and in the region of the closure 7 (and, if appropriate, of the further closure 8), the cover 10 of said transporting container has in each case one access opening 11 or 12, respectively.

For use for high-purity liquids, the single-piece transporting container, which is shown in FIGS. 1–4, or the inner container 8, for the design according to FIGS. 5 and 6, may be produced by coextrusion blow moulding, an inner-wall material which is selected specifically for the liquid which is to be introduced coating both the inner wall of the container and the submersion tube 1.

The transporting container may be designed in different shapes and sizes. For example, the embodiments illustrated may be designed with a height of approximately 900 mm and a diameter of approximately 600 mm, with the result that they have a gross volume of approximately 200 l.

What is claimed is:

1. A plastic transporting container for high purity chemicals, the container comprising:

a cylindrical side wall having an axially extending outwardly opening groove with a wall unitary with the wall of the tube and extending therein from a top wall of the container to a base of the container, and a submersion tube extending axially within the groove from the top wall to the container base, the submersion tube being both adjacent to and unitary with the cylindrical side wall and being fixed along the length thereof with respect to the groove by a laterally extending stiffening rib which extends across the groove and by a longitudinally extending web connecting the submersion tube to the groove, the web being unitary with the tube and wall of the groove.

2. The plastic transporting container of claim 1 wherein container is blow molded of a plastic which does not interact with high purity chemicals.

3. The plastic container of claim 2 wherein the material is polyethylene.

4. The plastic container of claim 1 wherein the container is cylindrical and has a gross volume of about 200 liters.

5. The plastic container of claim 4 wherein the container has a diameter of about 600 mm and a height of about 900 mm.

6. A plastic transporting container according to claim 1, wherein the container is a hollow body produced by blow molding.

7. A plastic transporting container according to claim 6, wherein the hollow body is produced by coextrusion blow molding, and in that an inner-wall material coats both the inner wall of the container and the submersion tube.

8. A plastic transporting container according to claim 1, wherein an end which opens out of the submersion tube in the top wall of the container, is provided with a screw-connection device and optionally equipped with a filling-related mechanical key code.

9. A plastic transporting container according to claim 1, wherein the plastic container is disposed within a steel outer container.

10. A plastic transporting container according to claim 9, wherein a cover of the steel outer container has an access opening aligned with each opening in the top wall of the plastic container.

11. A plastic transporting container according to claim 1 including a filing opening through the top wall disposed at a location spaced from the opening of the submersion tube.

* * * * *